US007710342B2

(12) United States Patent
Schadler et al.

(10) Patent No.: US 7,710,342 B2
(45) Date of Patent: May 4, 2010

(54) CROSSED-DIPOLE ANTENNA FOR LOW-LOSS IBOC TRANSMISSION FROM A COMMON RADIATOR APPARATUS AND METHOD

(75) Inventors: John L. Schadler, Raymond, ME (US); Ernest H. Mayberry, Falmouth, ME (US)

(73) Assignee: SPX Corporation, Charlotte, NC (US)

( * ) Notice: Subject to any disclaimer, the term of this patent is extended or adjusted under 35 U.S.C. 154(b) by 308 days.

(21) Appl. No.: 11/802,648

(22) Filed: May 24, 2007

(65) Prior Publication Data

US 2008/0291105 A1 Nov. 27, 2008

(51) Int. Cl.
*H01Q 21/26* (2006.01)

(52) U.S. Cl. ..... 343/797; 343/793

(58) Field of Classification Search ..... 343/797, 343/793, 792.5, 798, 810
See application file for complete search history.

(56) References Cited

U.S. PATENT DOCUMENTS 3,740,754 A * 6/1973 Epis ..... 343/797
5,838,282 A * 11/1998 Lalezari et al. ..... 343/727
5,929,820 A * 7/1999 Caulfield et al. ..... 343/761
6,768,473 B2 * 7/2004 Harland et al. ..... 343/890
6,823,177 B1 * 11/2004 Lucidarme ..... 455/103
7,084,822 B2 8/2006 Downs et al.

OTHER PUBLICATIONS

John L. Schadler, et al., "Antenna System And Method To Transmit Cross-Polarized Signals From A Common Radiator With Low Mutual Coupling", co-pending U.S. Appl. No. 11/698,065, filed Jan. 26, 2007.

Richard C. Johnson, Antenna Engineering Handbook, 3rd Edition; McGraw-Hill, Inc., 1993, pp. 3-7, 3-22, 19-6, 19-7 and 20-6.

* cited by examiner

*Primary Examiner*—Tho G Phan
(74) *Attorney, Agent, or Firm*—Baker & Hostetler LLP

(57) ABSTRACT

A dual-port corporate-feed broadband antenna uses two pairs of crossed dipoles in each bay, fed by a single hybrid coupler in each bay, to support hybrid-mode IBOC® VHF-band broadcasting. Each 3 dB quarter-wave coupler receives a share of an analog FM broadcast signal on a first input and a digital OFDM broadcast signal, 20 dB down, on a second input. The respective coupler output ports drive coaxial lines to tees feeding respective quarter-wave-separated crossed dipoles. The dipoles in each bay are arranged in a square to one side of their coupler, making side mounting practical. The resultant omnidirectional analog and digital radiation patterns have the same circular polarization and opposite phase rotation. Bay spacing for vertical null is a function ((n−1)/n) of the number of bays in the antenna.

20 Claims, 5 Drawing Sheets

10
16
14
12
116
102
D-A
18
D-D
20
TX-A
104
112
114
TX-D
106
C
108
110

CROSSED-DIPOLE ANTENNA FOR LOW-LOSS IBOC TRANSMISSION FROM A COMMON RADIATOR APPARATUS AND METHOD

FIELD OF THE INVENTION

The present invention relates generally to radio frequency (RF) electromagnetic signal antennas. More particularly, the present invention relates to dual-feed crossed-dipole circularly polarized broadband antennas for in-band, on-channel broadcasting.

BACKGROUND OF THE INVENTION iBiquity Corporation has developed a specification for its "in-band on-channel" (IBOC®) broadcasting system that meets the requirements of the Federal Communications Commission (FCC). Transmitting a hybrid (both analog and digital) IBOC®-compatible broadcast requires radiating an analog signal with frequency modulation (FM) technology and a digital signal with orthogonal frequency division multiplexing (OFDM) technology. The OFDM signal occupies the edges of the FM signal's emissions mask and has a total radiated power one hundredth (−20 dB) that of the FM signal. Each hybrid IBOC® signal uses one of the hundred radiotelephone channels for public reception established between television channels 6 and 7 in the very high frequency (VHF) band (88.1 MHz to 107.9 MHz). IBOC® also defines standards for all-digital VHF and for AM-band (535 KHz to 1705 KHz) radio.

A previous IBOC® antenna design disclosed in U.S. Pat. No. 7,084,822 ("the '822 patent"), incorporated herein by reference, includes crossed dipoles for radiation of analog and digital signals. The propagation concept disclosed includes, in at least one embodiment, two pairs of dipoles in each bay, with the dipoles in each pair spaced horizontally by a quarter wavelength, oriented at right angles to each other within parallel planes, and driven with two substantially unrelated signals, where the two signals are fed as traveling waves from opposite ends of a coaxial line and coupled therefrom to drive the dipoles.

A crossed-dipole pair so driven reinforces signal emission at some azimuths and cancels signal emission at other azimuths to produce generally peanut-shaped and overlaid circularly polarized patterns—beams—for the two signals. Each beam has two lobes; the lobes for that beam have the same circular polarization, but are opposite in phase at each instant. The '822 patent discloses a second dipole pair that taps the coaxial line a quarter wavelength from a first dipole pair for impedance cancellation, and that has an azimuthal orientation at right angles to that of the first pair, so that each bay radiates two circularly polarized signals with opposite handedness and oppositely rotating phase. The signals generally fill in at intermediate azimuths to an extent sufficient for the antenna to be termed omnidirectional.

While effective, this embodiment is somewhat constrained by the traveling-wave feed method, and is better suited to tower-top mounting and a small number of bays. A second embodiment in the '822 patent feeds crossed dipole pairs from taps on a traveling wave coaxial line, splitting the tapped signals to drive the pairs. This allows all of the radiating elements to be placed to one side of the coaxial line, but is still further limited in power by halving the number of coupling taps per radiator.

Another previous IBOC® antenna design is disclosed in copending U.S. application Ser. No. 11/698,065, filed Jan. 26, 2007, titled "Antenna System and Method to Transmit Cross-Polarized Signals from a Common Radiator with Low Mutual Coupling," incorporated herein by reference. This design includes separate corporate feed from analog and digital transmitters to a plurality of hybrid couplers per bay, each hybrid including unbalanced inputs and balanced outputs, so that multiple crossed-dipole radiators with integral cross-coupling cancellation can be provided in a plurality of bays with low mutual coupling. While highly effective, broad banded (>20% BW for VSWR<1.05:1), and high power capable, this design can be complex, preferably using either a tower-top mounting scheme or a plurality of discrete mountings around a tower or other structure to realize omnidirectional coverage.

Multiple-channel broadcast towers are costly to build and occupy significant amounts of real estate in rare locations (high up and near the center of population regions but low in local population, so transmitters can be clustered around them). Many such broadcast towers are relatively full, that is, they are limited in the number of antennas that can be mounted on them with adequate vertical separation, and desirable positions such as tower tops are typically already taken, leaving small or low positions or replacement of existing antennas as enhancement possibilities. Some IBOC®-compatible antenna designs are not readily adapted to tower-side mounting, because they use highly symmetrical structures to achieve omnidirectional patterns and would require robust, extended—and massive—cantilever brackets for tower side mounting.

SUMMARY OF THE INVENTION

The foregoing disadvantages are overcome, to a great extent, by the present invention, wherein in one aspect a circularly polarized, corporate-feed IBOC®-compliant antenna is provided that in some embodiments affords simplicity in mechanical construction, moderate power capability, high gain, broad bandwidth, good azimuth coverage, adaptability for vertical null, beam tilt, and null fill, little phase runout, and suitability to tower side mounting.

In accordance with one embodiment of the present invention, an antenna system for broadcasting radio frequency (RF) electromagnetic (EM) signals over a frequency range is presented. The antenna includes a first pair of crossed dipoles, a second pair of crossed dipoles, a hybrid coupler that includes a first input port, a second input port, a first output port, and a second output port, a first coaxial interconnecting tee from the hybrid coupler first output port to the respective ones of the first pair of crossed dipoles, and a second coaxial interconnecting tee from the hybrid coupler second output port to the respective ones of the second pair of crossed dipoles.

In accordance with another embodiment of the present invention, an antenna system for broadcasting radio frequency (RF) electromagnetic (EM) signals, operational over a frequency range, is presented. The antenna includes radiators for radiating an analog frequency-modulated (FM) broadcast-level electromagnetic signal assigned to a channel within the Federal Communications Commission (FCC)-assigned very high frequency public radiotelephone band (VHF band) having a circular polarization, a direction of phase rotation, and a specified extent of gain with respect to a single dipole, and radiators for radiating a digital orthogonal frequency division multiplexed (OFDM) broadcast-level electromagnetic signal assigned to the same channel as the analog signal, having the same circular polarization as the analog signal, opposite direction of phase rotation from the FM signal, and gain that is substantially equal to the gain of the FM signal. In the antenna, the relative power levels of the FM and OFDM signals comply with FCC requirements and further comply with specifications defined by iBiquity® Corporation for In-Band On-Channel (IBOC®) transmission, the radiators for radiating the FM and OFDM signals are positioned at four discrete locations uniformly distributed on a quarter-wavelength square in each of a plurality of vertically-displaced bays, the radiators for radiating the FM signals and the radiators for radiating the OFDM signals are the same physical devices, the FM and OFDM signals are presented to the radiators using corporate feed, and interbay spacing is a function of vertical beam null.

In accordance with still another embodiment of the present invention, a method of broadcasting radio frequency (RF) electromagnetic (EM) signals, operational over a frequency range, is presented. The method may include generating a first broadcast signal, generating a second broadcast signal, applying the first signal to a first power divider, applying the second signal to a second power divider, applying a first output signal from the first divider to a first input port of a first 3 dB quarter-wave hybrid coupler, applying a first output signal from the second divider to a second input port of the first hybrid, dividing a first output signal from the first hybrid with a first tee divider, and dividing a second output signal from the first hybrid with a second tee divider. The method may further include applying respective outputs from the first tee divider to a first two orthogonally crossed dipoles, separated by a quarter wavelength, located in parallel planes perpendicular to a ground plane, wherein a line connecting the first-dipole midpoints is orthogonal to the parallel planes of the first two crossed dipoles, and applying respective outputs from the second tee divider to a second two orthogonally crossed dipoles, separated by a quarter wavelength, located in parallel planes perpendicular the planes of the first two dipoles and to a ground plane, wherein a line connecting the second-dipole midpoints is orthogonal to the parallel planes of the second two crossed dipoles.

There have thus been outlined, rather broadly, features of the invention, in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
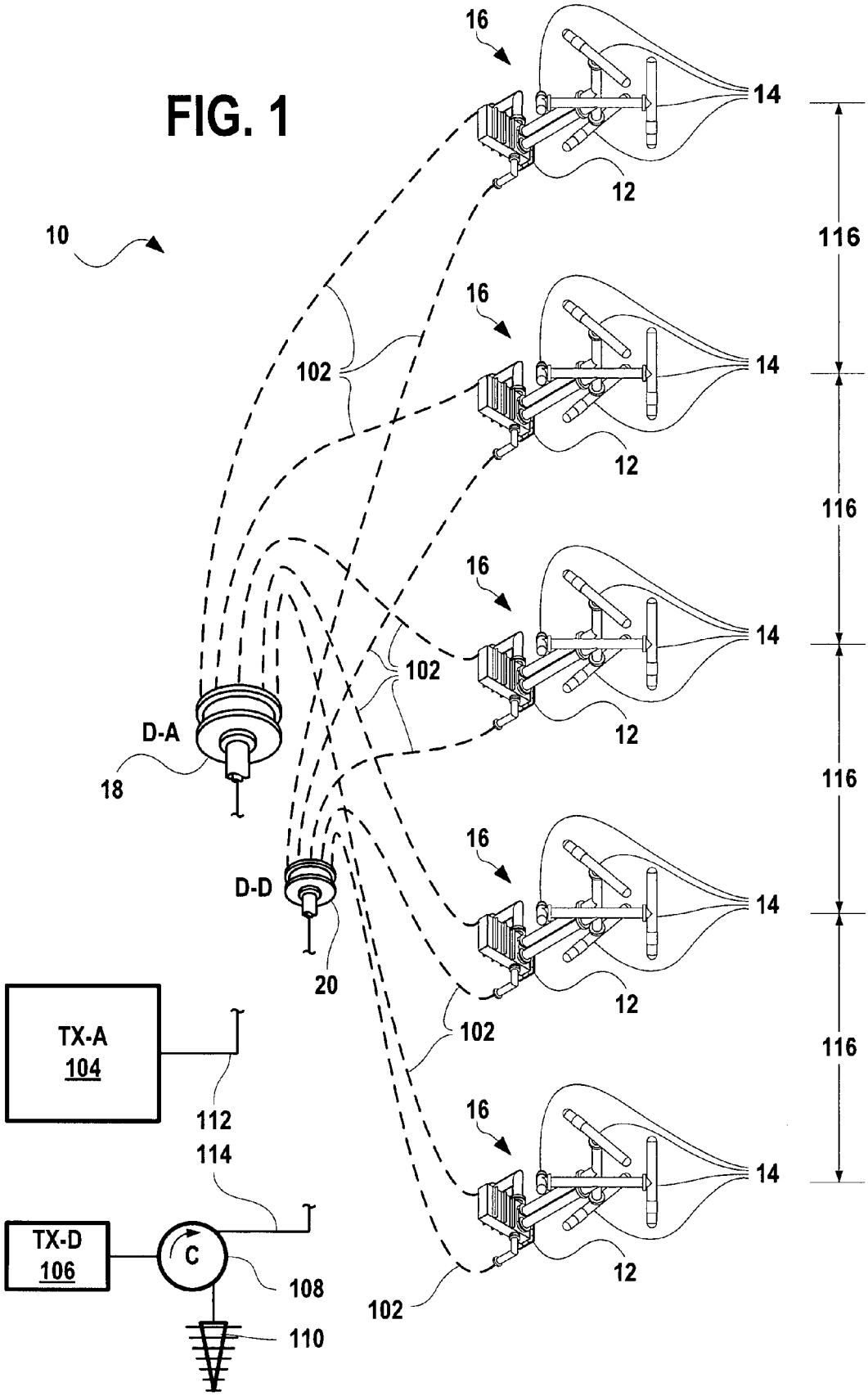
FIG. 1 is a perspective view of a multiple-bay antenna according to one embodiment of the instant invention.

The invention will now be described with reference to the drawing figures, in which like reference numerals refer to like parts throughout. The present invention provides an apparatus and method that in some embodiments provides a dual-port antenna that supports two isolated broadcasts with substantially null-free, circularly-polarized, rotating-phase propagation patterns, selectable gain, and moderate power handling capability.

FIG. 1 shows a multiple-bay crossed dipole antenna 10 in schematic form according to one embodiment of the instant invention. The antenna 10 complies with Federal Communications Commission (FCC) requirements for analog frequency-modulated (FM) broadcast-level electromagnetic signal generation for very high frequency public radiotelephone band (VHF band) broadcasting, and with specifications defined by iBiquity® Corporation for a digital orthogonal frequency division multiplexed (OFDM) broadcast-level electromagnetic signal for In-Band On-Channel (IBOC®) transmission. The antenna 10 uses one hybrid 12 and two pairs of crossed dipoles 14 per bay 16. A high-power divider 18 for corporate feed of the analog signal and a low-power divider 20 for corporate feed of the digital signal are located within the aperture of the antenna in the embodiment shown. For other embodiments, the dividers 18 and 20 may be fitted at any suitable location, such as at a tower base (not shown). Such factors as wind and weight loading of the dividers 18 and 20 may be offset by wind and weight loads of individual coaxial lines 102 coupling the dividers 18 and 20 to the hybrids 12 in some of these embodiments.

Feed lines 102 from the dividers 18 and 20 to the individual hybrids 12 in the bays 16 are equal in length in a realization of the embodiment shown. This configuration, in conjunction with providing dividers 18 and 20 that are substantially uniform in transit time from an input port to all output ports, can provide low phase runout, wherein phase runout is a factor degrading beam precision. In other embodiments, closer-in feed lines 102 can be made shorter by, for example, a wavelength per bay 16; this may reduce weight and wind loading while reducing performance to some extent. Other embodiments, such as ones which may use traveling wave feed lines in lieu of a power divider, may feed successive bays with successively delayed signals, increasing phase runout in exchange for structural robustness and configuration simplicity.

Signals for the antenna of FIG. 1 originate in an analog transmitter 104 and a digital transmitter 106, shown schematically, with at least the digital transmitter 106 protected by a circulator 108 and a dissipative load 110, connected by respective coaxial lines 112 and 114 from a location for the transmitters 104, 106 that is near an antenna tower (not shown) in at least some embodiments. Electrical power, broadcast information sources, connections thereof to the respective transmitters 104, 106, station loads, a tower, and other apparatus required for a complete broadcasting facility, are not shown in FIG. 1.

Figure 2:
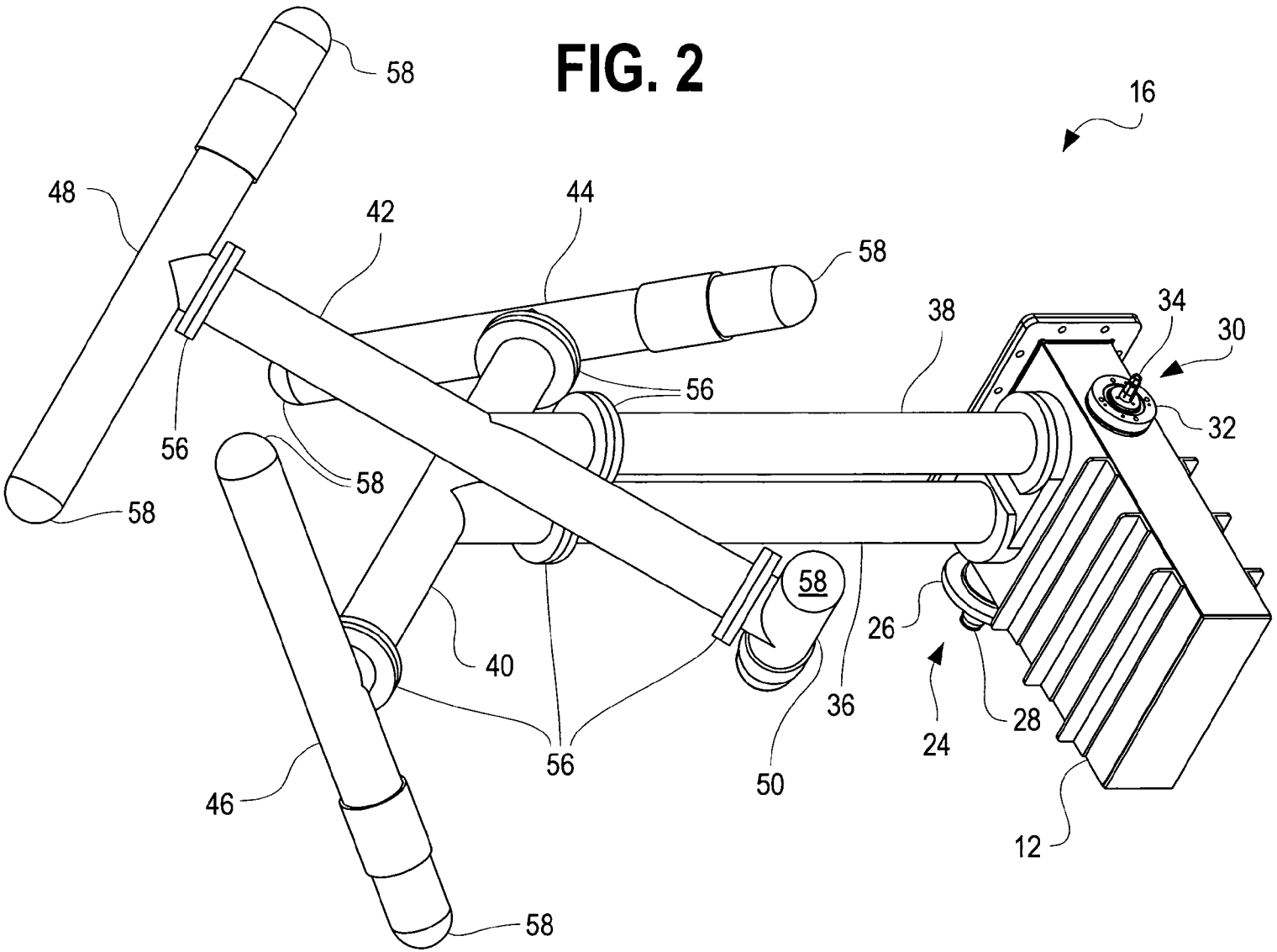
FIG. 2 is a perspective view of one bay of an antenna according to one embodiment of the instant invention.
Figure 5:
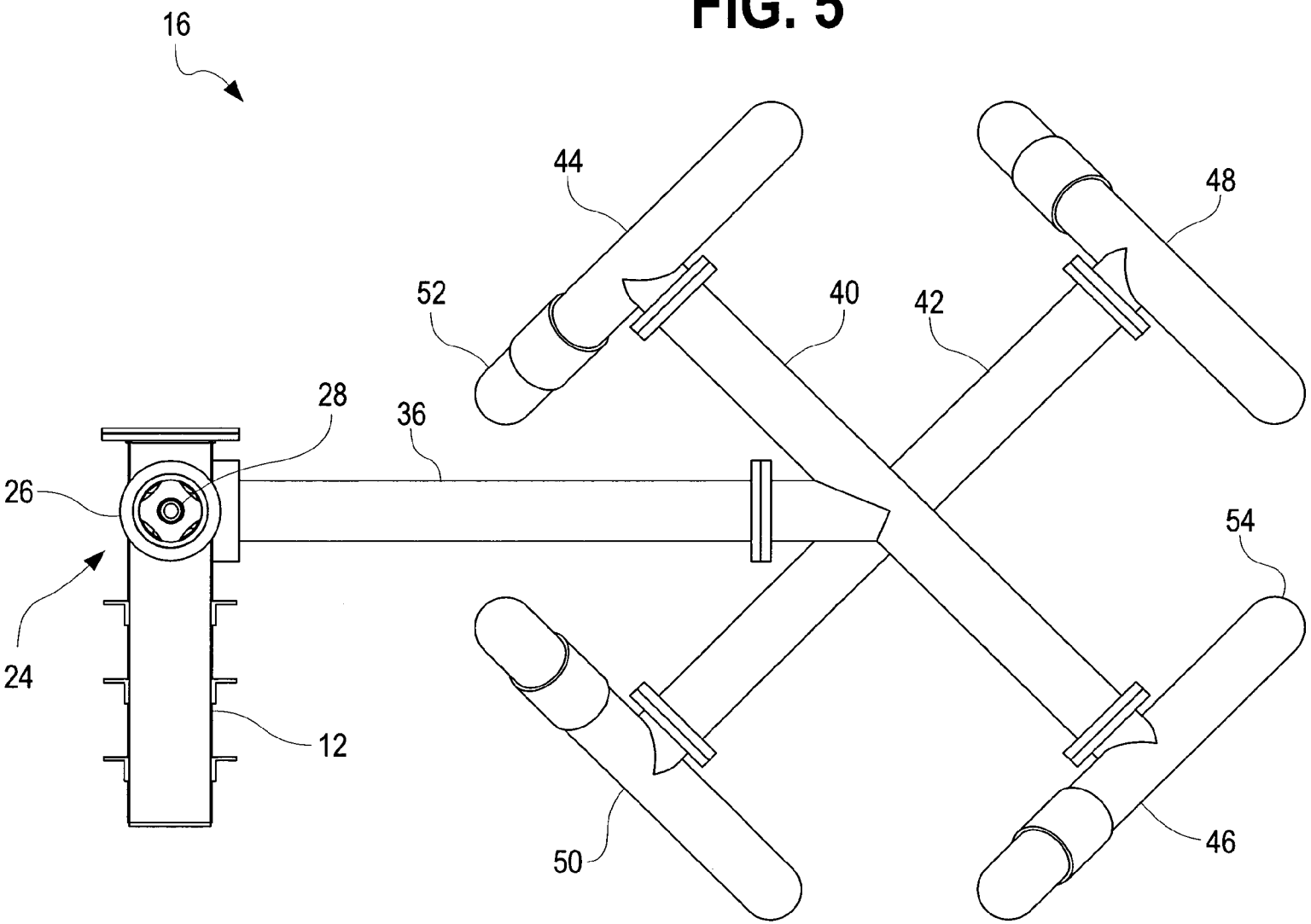
FIG. 5 is a bottom view of the bay of FIG. 2.

The antenna of FIG. 1 provides a plurality of bays 16 of the form of FIGS. 2 and 5, with gain realized by spacing the bays 16 at preferred vertical intervals 116 and by aligning dipoles having corresponding azimuth orientations in the respective bays 16 so that synchronous rotating-phase signals are emitted from all bays 16. An antenna having a single bay 16 of the configuration shown may be preferred in some embodiments.

Bandwidth in the embodiment shown may be widened by combining large element diameter, selection of connector, hybrid, and power divider designs, providing short, low-loss, and/or equal-length coaxial lines, and the like. Multiple low-level- or high-level-combined channels may be present in each of the transmitter apparatuses 104 and 106 shown.

FIG. 2 shows a single bay 16 of an antenna 10 shown in FIG. 1. A single hybrid 12 within the bay 16 shown has a high-power coaxial (unbalanced) input fitting 24, having an outer-conductor flange 26 and an inner conductor coupling 28, known in the art as a "bullet", and a low power coaxial (unbalanced) input fitting 30, having an outer conductor mounting flange 32 and an inner conductor bullet 34. The hybrid 12 has two coaxial output lines 36 and 38, respectively, terminating in coaxial crossbars 40 and 42 that divide the signals applied to them into substantially equal portions. The portions in the first indicated crossbar 40 propagate outwardly with equal phase to excite terminal dipoles 44 and 46, while the portions in the crossbar 42 propagate outwardly with equal phase to excite terminal dipoles 48 and 50.

Junction impedance between the hybrid output lines 36 and 38 and the respective coaxial crossbars 40 and 42—each representing two loads in parallel—can be matched by doubling the relative line impedance of the latter.

$$Z = K\frac{\log\left(\frac{D}{d}\right)}{\sqrt{\varepsilon}} \tag{1}$$

where

Z=impedance

K=a proportionality constant

D=outer conductor inner diameter d=inner conductor outer diameter

∈=dielectric constant (epsilon)

For example, by decreasing the crossbar inner conductor diameter d or by filling the output lines 36 and 38 with an insulator having a relatively high dielectric constant while leaving the crossbars 40 and 42 air-filled, impedance can be readily matched. Other impedance-matching methods are also well known in the art, and the foregoing methods should not be viewed as limiting. Flanges 56 shown at the entrances to the crossbars 40 and 42 and to the dipoles 44, 46, 48, and 50 are commonly employed for convenience in manufacture, and likewise should not be viewed as limiting. Radiused dipole ends 58 as shown are one of several known approaches for controlling electrostatic discharge, bandwidth, and other properties, and should likewise not be viewed as limiting.

Figure 3:
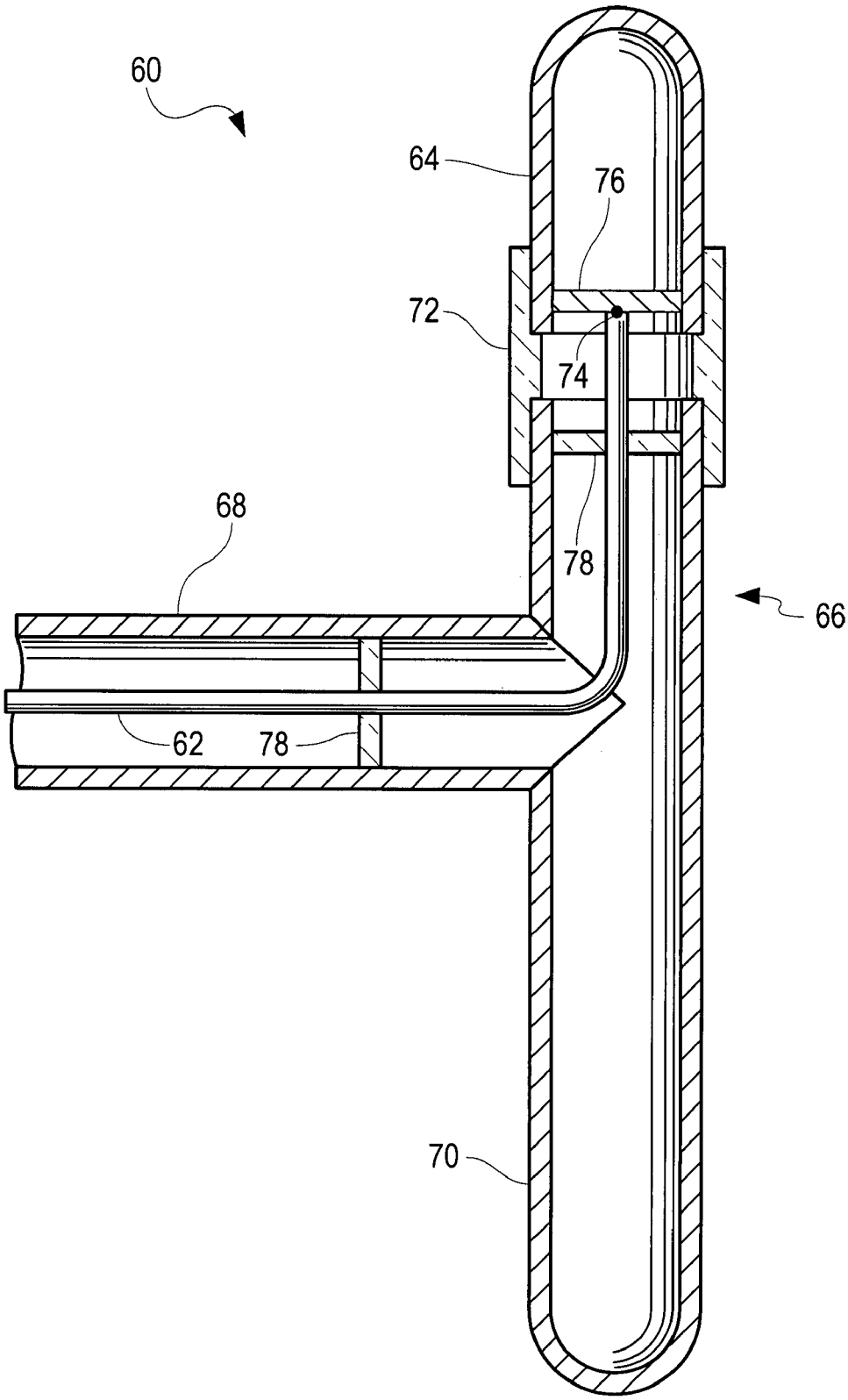
FIG. 3 is a schematic partial section view of a dipole feed arrangement according to one embodiment of the instant invention.

FIG. 3 shows, in section, a largely schematic arrangement 60 for coupling an inner conductor 62 of a crossbar to a "hot" monopole 64 of a terminal dipole 66. The crossbar outer conductor 68 has electrical continuity with this terminal dipole's "cold" monopole 70, while the crossbar inner conductor 62 feeds past an insulating section 72 to connect to the hot monopole 64. A joining location 74 includes a conductive wafer 76 brazed or otherwise electrically coupled to the hot monopole 64 near the cold monopole 70. This is one of several well-known joining methods, each typically having particular impedance and propagation characteristics, and should not be viewed as limiting. Methods for fine adjustment of dipole length and for sealing the interior volume of the antenna against contaminants are well known in the art, are not critical to the illustrated schema, and are not detailed in the section view of FIG. 3. Likewise, internal arrangements for the flanges 56 of FIG. 2 are not critical to the dipole feed function and are not detailed in this section view. Similarly, insulating inner-conductor positioning spacers 78 are shown largely schematically; in practice, such spacers can have many forms, and are chosen for suitability to a specific embodiment.

In some embodiments, center-fed dipoles having lengths approximating a half wavelength may be employed. However, as is well known in the art, performance approaching that of full-size dipoles may be realized by shortening the dipoles and moving and configuring the driving point sufficiently to maintain a preferred value of impedance. While an arrangement of the latter kind applies for the embodiment shown, this should not be viewed as limiting.

Figure 4:
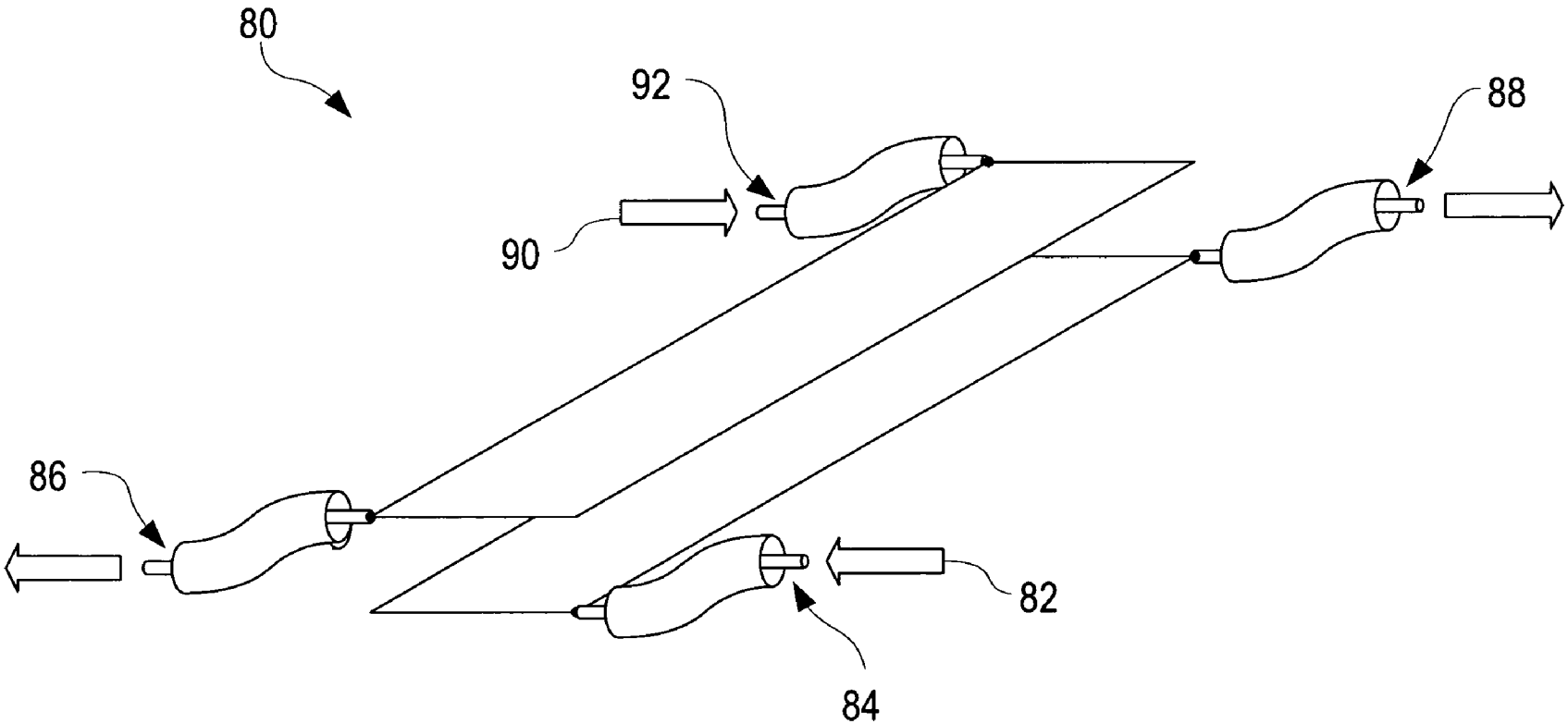
FIG. 4 is a schematic representation of a hybrid coupler illustrating the concepts employed in the instant invention.

FIG. 4 schematically illustrates a coaxially-fed hybrid coupler 80. A first input signal 82, applied to a first input port 84, is divided in half (depending on exact dimensions of coupler 80 structure and the frequency of the applied signal), with a first half coupled electromagnetically to a first output port 86 with nominal (reference) delay and a second half conveyed conductively to a second output port 88 with one-quarter wavelength of additional delay. A coupler 80 of proper design and correct first input signal 82 frequency reduces or prevents signal 82 leakage at a second input port 92. A second input signal 90, applied to the second input port 92 and treated like the first input signal 82, provides a reference-delay half emitted at the second output port 88, a quarter-wave-delayed half emitted at the first output port 86, and substantially no leakage at the first input port 84. Isolation between the two input signals 82 and 90 in at least some embodiments can be on the order of 30 dB or better.

This so-called 3 dB, 90 degree, or quarter-wave hybrid coupler, combiner, splitter, or divider 80 has many applications in the art. Geometries other than the indicated rectangular stripline are used for this and other frequency ranges, power ratios, and relative phase angles, so that the configuration shown should not be viewed as limiting. For example, a so-called magic tee hybrid produces a 180 degree delay (one-half wavelength) in an open line, coaxial line, stripline, or waveguide realization if configured for a suitable frequency range and power level. Power ratios other than 3 dB (e.g., 6 dB, 10 dB, 20 dB) may be realized by adjusting dimensions and frequencies for a given application. The hybrid shown in FIGS. 1, 2, and 5 has a horseshoe-shaped internal layout that allows placement of inputs and outputs in the spatial locations indicated in those figures while realizing 3 dB power split, quarter-wave phase shift, and isolation between input ports for a specified frequency range. Other hybrid configurations may provide comparable capability, and may be preferred in some embodiments.

Returning to FIG. 4, a correctly configured hybrid, as discussed above, effectively isolates two applied signals 82, 90 from each other, including masking the digital (OFDM) input port (92 in FIG. 4, at 30 in FIG. 2) from the analog (FM) input port (84 in FIG. 4, at 24 in FIG. 2), so that the high-power signal 82 applied to the analog port 84 is substantially prevented from propagating to the digital transmitter (106 in FIG. 1). As a result, reduced protection is needed to prevent the digital transmitter 106 from being overloaded or modulated by the analog transmitter (104 in FIG. 1), while the analog transmitter 104 is substantially immune from overload or modulation by the digital transmitter 106 because of both this isolation and the greater output power of the analog transmitter 106. Thus, in a typical embodiment, a circulator (108 in FIG. 1) and dissipative load (110 in FIG. 1) of modest power handling capability are sufficient to support operation of a properly-sized digital transmitter 106 and a likewise properly-sized analog transmitter 104 for IBOC® applications.

FIG. 5 shows a bottom view of the bay 16 shown in FIG. 2. The crossbars 40 and 42 are shown at right angles to each other. The angle from the cross bar 40 to the output coaxial line 36 from the hybrid 12 is approximately 45 degrees in this embodiment; this is one of several realizable arrangements, and should not be viewed as limiting. The feed arrangement for the high power hybrid input 24 having a flange 26 and a center conductor bullet 28, is also shown. All four dipoles 44, 46, 48, and 50 are oblique to the viewing plane.

It may be properly inferred that the dipoles 44 and 46 are coupled to the center conductor of associated crossbar 40 by an arrangement comparable to that shown in FIG. 3. The dipoles 44 and 46 of this pair, separated by one-quarter wavelength, are driven in phase and spatially rotated by 90 degrees to each other with the relative orientation shown in FIGS. 2 and 5. As a consequence, a component of a first signal, fed to the high-power port 24, emitted from a first dipole 44, propagated in the direction of the second dipole 46, and reinforced by a corresponding component of the first signal emitted from the second dipole 46, forms a circularly polarized signal with a particular handedness. For example, assuming that applied signals having horizontal and vertical components $E_H$ and $E_V$, respectively, appear as $E_1$ at a first dipole 44 rotated 45 degrees from the horizontal in a positive direction, and as $E_2$ at a second dipole 46 rotated a like amount in a negative direction, $$E_1=E_{H1}+E_{V1}=E_1\cos\theta+E_1\sin\theta \tag{2}$$

$$E_2=E_{H2}+E_{V2}=E_2\cos(-\theta)+E_2\sin(-\theta)=-E_2\cos\theta+E_2\sin\theta \tag{3}$$

For β=distance between the radiators in wavelengths (λ), the instantaneous sum S of the signals $E_1$ and $E_2$ is $$S=E_1+E_2\cos\beta \tag{4}$$

Let $E_1=E_2=E$, i.e., equal signals applied in phase to the respective dipoles. Then $$E_H=E\cos\theta+(-E\cos\theta\cos\beta)=E\cos\theta(1-\cos\beta) \tag{5}$$

$$E_V=E\sin\theta+(E\sin\theta\cos\beta)=E\sin\theta(1+\cos\beta) \tag{6}$$

If β=π/2 [i.e., 90 degrees, or λ/4], then cos β=cos(π/2)=0. Then $$E_H=E\cos\theta \tag{7}$$

and $$E_V=E\sin\theta \tag{8}$$

If β=π, then cos β=cos π=−1. Then $$E_H=0 \tag{9}$$

and $$E_V=2E\sin\theta \tag{10}$$

Thus, with dipole spacing of one quarter wavelength, horizontal and vertical components are equal, achieving approximately circular polarization. However, with dipole spacing of one half wavelength, the horizontal component is zero, all of the energy is in the vertical component, and a vertical linear output polarization is realized. Similarly, changing the spacing β to one wavelength realizes horizontal linear output polarization.

Signals emitted from each dipole in the direction of the other form lobes having the same handedness of circular polarization. The lobes are opposite in polarity, however—that is, with reference to the midpoint of the crossbar, the lobes differ by 180 degrees in both phase and azimuth.

Signal components at azimuths perpendicular to these lobes largely cancel at far field, as the dipoles are oppositely polarized but equal in phase, and emit proximally. Signal energy at intermediate azimuths reinforces to an intermediate extent and retains circular polarization. Unlike some radiator configurations, the crossed dipoles form similar beams in azimuth and elevation, so two circularly-polarized lobes in a peanut pattern are formed.

The hybrid 12 delays the first signal to the distal output coax 38 (not shown in FIG. 5) by an additional 90 degrees, so first-signal emission from dipoles 48 and 50 is identical to that of dipoles 44 and 46 but delayed by 90 degrees. Therefore, a signal peak occurs on dipole 44, followed by a peak on dipole 48, 90 degrees thereafter, then on dipole 46, 180 degrees after dipole 44, and on dipole 50, 270 degrees after dipole 44. Thus, not only does the first signal produce a second circularly-polarized peanut lobe pattern on dipoles 48 and 50, but the four dipoles produce a signal having rotating phase that advances clockwise in azimuth (44-48-46-50).

A second signal, fed to the hybrid 12 at the low-power port 30, shown in FIG. 2, emits first from the distal dipoles 48 and 50, then the foreground dipoles 44 and 46. As phased by the hybrid 12, the second signal is also right-hand circularly polarized, but rotates counterclockwise in azimuth (48-44-50-46).

Vertical placement of bays 16, shown in FIG. 1, may be at any of several intervals. In many embodiments, a user will seek to reduce a number of bays 16 in an available aperture consistent with available transmitter 104, 106 power output, thereby reducing material cost, complexity, and wind loading while having comparatively little effect on gain and spurious beam propagation. Some of these embodiments provide vertical-radiation nulls—that is, the embodiments minimize mutual coupling between radiators while avoiding generating strong downward beams and wasted upward beams. The nulls in an elevation pattern with all bays 16 driven in phase are defined by:

$$\delta=\sin^{-1}\left(\frac{k\lambda}{nd}\right) \tag{11}$$

where

δ=null angle
k=an integer
d=distance between bays
n=number of elements
λ=wavelength k≠n (this is a critical consideration: whole-number-wavelength spacing does not work.)

To minimize downward radiation and interbay coupling, a null at δ=90 degrees is required:

$$\frac{k\lambda}{nd} = 1 \Leftrightarrow d = \frac{k\lambda}{n} \tag{12}$$

for $k = 1, 2, 3, \ldots, n-1, n+1, \ldots$ or $$d = \frac{\lambda}{n}, \frac{2\lambda}{n}, \ldots, \frac{(n-1)\lambda}{n}, \frac{(n+1)\lambda}{n}, \ldots \tag{13}$$

It will be noted that the most aperture-efficient spacing is $$\frac{(n-1)}{n}\lambda \tag{14}$$

—that is, close to but less than one wavelength. Closer spacings have other drawbacks, such as lower antenna gain in proportion to complexity, and thus higher wind loading and material and operating cost in proportion to broadcast coverage. Wider spacings can lead to grating lobes (side lobes replicating the main beam; see Johnson, R. C., *Antenna Engineering Handbook,* 3*rd Edn*., McGraw-Hill, 1993, pp. 3.7, 3.22, 19.6-7, 20.6) as well as increased tower footprint and reduced efficiency. Thus, for example, if an aperture of four wavelengths of tower height (plus gaps between the antenna in question and those above and below) is available, then n−1=4, the number of radiators is 5, and a spacing of 0.8 wavelengths between adjacent bays is the value that may be preferred for many embodiments.

It is to be understood that other considerations may override this optimization for some embodiments. Beam tilt, for example, may dictate some adjustment to the indicated (uniform) spacing, while null fill may be provided by making the spacing nonuniform, while retaining spacing near (n−1)/n. Spacings other than (n−1)/n may be appropriate for still other embodiments, such as those having abundant transmitter power available, or not requiring a vertical null. At another extreme, a single-bay configuration conforms to the description, with a vertical spacing between bays of zero.

Vertical displacement between the crossbars 40 and 42 in the embodiment shown in FIG. 2 is a small fraction of a wavelength, and is of little net effect. Other feed arrangements, such as ones that place the pairs of dipoles more nearly at a common height or more displaced vertically, are also feasible, so that cost and other secondary considerations may dictate layout within each bay 16. In all cases, however, the four dipoles 44, 48, 46, and 50 of each bay 16 may be seen to be approximately centered on respective edges of a planar square parallel to a ground plane representing the surface above which the antenna is mounted, parallel to an effective radiation plane of the antenna 10, and intermediate between the coaxial feed lines 36 and 38 directed to the crossbars 40 and 42 of the bay 16, the perimeter of which square lies in the planes of the respective dipoles 44, 48, 46, and 50.

Distance from the hybrid 12 to the crossbars 40 and 42 is not required to be a tuned length. As a consequence, any length may be selected for the coaxial feed lines 36 and 38 from the hybrids 12, in keeping with structural considerations (ice and wind loading, etc.) and interrelationship between the tower and the achieved radiation pattern.

The antenna is made substantially omnidirectional by having relatively equal lobes spaced at 90 degrees in azimuth and limiting nulls between lobes. The lobes are oblique to the feed hybrids 12 in the embodiment shown, so that only slight pattern degradation is caused by mounting the antenna alongside a guyed or freestanding tower. Any metallic or otherwise reflective tower parts may affect the achieved pattern inversely to configuration and distance from the respective tower parts to the antenna dipoles 44, 48, 46, and 50. Orientation may be optimized with known antenna ray tracing software followed by validation testing and adjustment. Installed height and the presence of other antennas on the tower will likewise affect final far-field signal characteristics.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. An antenna system for broadcasting radio frequency (RF) electromagnetic (EM) signals, operational over a frequency range, comprising:

a first pair of crossed dipoles having substantially the same dimensions and electrical properties, spaced apart by approximately one-quarter wavelength of a reference frequency within the operational frequency range, lying in parallel planes substantially orthogonal to a ground reference plane for the antenna system, and perpendicular to each other;

a second pair of crossed dipoles;

a hybrid coupler comprising a first input port, a second input port, a first output port, and a second output port;

a first connection connecting the first output port to the first pair of crossed dipoles; and a second connection connecting the second output port to the second pair of crossed dipoles.

2. The antenna system of claim 1, wherein the hybrid coupler is configured to provide a first combined signal at the first output port, wherein the first combined signal comprises a first signal first output of substantially half of a coupler first input signal with a first-signal nominal phase delay, and a second signal second output of substantially half of a coupler second input signal with a phase delay greater than the second-signal nominal phase delay by an amount substantially equal to ninety degrees of the reference frequency.

3. The antenna system of claim 2, wherein the hybrid coupler is configured to provide a second combined signal at the second output port, wherein the second combined signal comprises a first signal second output with substantially half of a coupler first input signal with a phase delay greater than the first-signal nominal phase delay by an amount substantially equal to ninety degrees of the reference frequency, and a second signal first output with substantially half of a coupler second input signal with a second-signal nominal phase delay.

4. The antenna system of claim 2, wherein the coupler first input signal comprises at least one VHF band frequency-modulated (FM) analog signal, wherein the coupler second input signal comprises at least one VHF band orthogonal frequency division multiplexed (OFMD) digital signal having signal characteristics in accordance with In-Band On-Channel transmission specifications, and wherein each OFDM digital signal operates on a broadcast channel whereon an FM analog accepted by the antenna also operates.

5. The antenna system of claim 1, wherein the second pair of crossed dipoles are substantially the same as the first pair of crossed dipoles, lie in planes substantially orthogonal both to the planes of the first pair of crossed dipoles and to the ground plane, and are perpendicular to each other.

6. The antenna system of claim 1, wherein respective dipoles are shortened from approximately one-half wavelength of the reference wavelength in length to an extent proportional to driving point impedance compensation applied thereto.

7. The antenna system of claim 1, wherein the first connection is configured to at least one of couple a signal from the first output port, divide the first combined signal into two substantially equal and co-phased portions, and apply one of the two portions to each of the dipoles of the first pair of crossed dipoles.

8. The antenna system of claim 7, wherein the second coaxial interconnecting tee is configured to couple the second combined signal from the second output port, to divide the second combined signal into two substantially equal and co-phased portions, and to apply one of the two portions to each of the dipoles of the second pair of crossed dipoles.

9. The antenna system of claim 1, wherein the hybrid coupler and the associated interconnections and dipoles further comprise a first bay of a broadcast antenna, wherein corresponding component parts in each bay of a plurality of substantially identical bays have like orientation and are vertically aligned, and wherein the antenna system further comprises a first corporate feed power divider and a second corporate feed power divider.

10. The antenna system of claim 9, wherein, in response to application of one broadcast signal thereto, each of the respective corporate feed power dividers is configured to output a plurality of divider output signals having a specified phase relationship to the applied signal, wherein each of the divider output signals is substantially identical to the applied signal except for having a power level that is a substantially equal fraction of the applied signal.

11. The antenna system of claim 9, wherein, in response to application of one broadcast signal thereto, each of the respective corporate feed power dividers is configured to output a plurality of divider output signals having a specified phase relationship to the applied signal, wherein each of the divider output signals is substantially identical to the applied signal except for having a power level that is a fraction of the applied signal, the value of which fraction is a logarithmic function of the position of the bay for which the respective divider output signals are intended.

12. The antenna system of claim 9, wherein the hybrid coupler provides isolation between the applied analog and digital inputs.

13. The antenna of claim 9, further comprising realization of vertical radiation nulls by establishment of an interbay spacing d selected from the list consisting of $$d = \frac{\lambda}{n}, \frac{2\lambda}{n}, \ldots, \frac{(n-1)\lambda}{n}, \frac{(n+1)\lambda}{n}, \ldots,$$

where d is a distance between radiation centers of respective uniformly-spaced bays, λ is a wavelength corresponding to a frequency within the antenna's functional range, and n is a number of bays of which the antenna is comprised.

14. The antenna system of claim 13, wherein interbay spacing further comprises:

means for canceling a vertically-oriented component of broadcast energy by conforming relative vertical placement of radiating elements to a formula $$d = \frac{\lambda}{n}, \frac{2\lambda}{n}, \ldots, \frac{(n-1)\lambda}{n}, \frac{(n+1)\lambda}{n}, \ldots,$$

where d is a distance between radiation centers of respective uniformly-spaced bays, λ is a wavelength corresponding to a frequency within the antenna's functional range, and n is a number of bays comprising an antenna.

15. A method for broadcasting radio frequency (RF) electromagnetic (EM) signals, operational over a frequency range, comprising:

generating a first and a second broadcast signal;

applying the first signal to a first power divider and the second signal to a second power divider;

applying a first output signal from the first divider to a first input port of a first coupler and a first output signal from the second divider to a second input port of the first coupler;

dividing a first output signal from the first coupler with a first tee divider and dividing a second output signal from the first coupler with a second tee divider;

applying respective outputs from the first tee divider to a first two orthogonally crossed dipoles, separated by a quarter wavelength, located in parallel planes perpendicular to a ground plane, wherein a line connecting the first-dipole midpoints is orthogonal to the parallel planes of the first two crossed dipoles; and applying respective outputs from the second tee divider to a second two orthogonally crossed dipoles, separated by a quarter wavelength, located in parallel planes perpendicular the planes of the first two dipoles and to a ground plane, wherein a line connecting the second-dipole midpoints is orthogonal to the parallel planes of the second two crossed dipoles.

16. The broadcasting method of claim 15, further comprising:

orienting the first two dipoles to propagate the first EM signal in both directions along the line of the first-dipole midpoints, with circular polarization of like handedness, and with opposite polarities in the two first-dipole directions;

further orienting the first two dipoles to propagate the second EM signal in both directions along the line of the first-dipole midpoints, with like circular polarization to the first EM signal, and with opposite polarities in the two first-dipole directions;

orienting the second two dipoles to propagate the first EM signal in both directions along the line of the second-dipole midpoints, substantially orthogonal to the propagation line of the first two dipoles, with like circular polarization to the signals of the first two dipoles, and with opposite polarities in the two second-dipole directions;

further orienting the second two dipoles to propagate the second EM signal in both directions along the line of the second-dipole midpoints, with like circular polarization to the first EM signal, and with opposite polarities in the two second-dipole directions, wherein the phase of the first EM signal from the second two dipoles differs by a quarter-wave from the phase of the first EM signal from the first two dipoles, and wherein the phase of the second EM signal from the second two dipoles differs by a quarter-wave from the phase of the second EM signal from the first two dipoles.

17. The broadcasting method of claim 15, wherein the first broadcast signal further comprises an analog frequency-modulated (FM) broadcast-level EM signal assigned to a channel within the very high frequency public radiotelephone band (VHF band), wherein the second broadcast signal further comprises a digital orthogonal frequency division multiplexed (OFDM) broadcast-level EM signal assigned to the same channel as the analog signal, and wherein the relative power levels of the FM and OFDM signals comply with In-Band On-Channel transmission specifications.

18. The broadcasting method of claim 15, wherein the FM divider is configured to provide a plurality of outputs that are substantially equal in magnitude and phase and the OFDM divider is configured to provide a plurality of outputs that are substantially equal in magnitude and phase.

19. The broadcasting method of claim 15, further comprising:

applying a first plurality of output signals from the first power divider to respective first input ports of a plurality of 3 dB quarter-wave hybrid couplers, wherein the first-divider output signals are substantially identical in energy content and phase, and wherein the respective first-divider output signals are applied to respective hybrids through transmission paths of substantially equal electrical length;

applying a second plurality of output signals from the second power divider to respective second input ports of a plurality of 3 dB quarter-wave hybrid couplers, wherein the second-divider output signals are substantially identical in energy content and phase, and wherein the respective second-divider output signals are applied to respective hybrids through transmission paths of substantially equal electrical length;

dividing all of the outputs from the plurality of hybrids with tee dividers; and applying the respective tee divider outputs to dipoles arranged substantially identically to the dipoles connected to the first hybrid.

20. The broadcasting method of claim 19, further comprising:

locating the respective hybrid couplers in a vertical array, wherein vertical spacing between hybrid couplers is a function of the number of hybrid couplers and the frequency range of the broadcasting method, and wherein the spacing provides a substantially null signal strength along a vertical axis of the array;

positioning dipoles connected to respective hybrid couplers in corresponding locations with like orientations; and aligning corresponding dipoles along axes parallel to the vertical axis of the array.

* * * * *